US012245645B2

(12) United States Patent
Wong

(10) Patent No.: US 12,245,645 B2
(45) Date of Patent: Mar. 11, 2025

(54) ADJUSTABLE LENGTH GARMENT DEVICE

(71) Applicant: Whislie Wong, San Francisco, CA (US)

(72) Inventor: Whislie Wong, San Francisco, CA (US)

( * ) Notice: Subject to any disclaimer, the term of this patent is extended or adjusted under 35 U.S.C. 154(b) by 0 days.

(21) Appl. No.: 18/056,077

(22) Filed: Nov. 16, 2022

(65) Prior Publication Data

US 2023/0148687 A1 May 18, 2023

Related U.S. Application Data

(60) Provisional application No. 63/279,894, filed on Nov. 16, 2021.

(51) Int. Cl.
*A41D 15/00* (2006.01)
*A41D 1/14* (2006.01)

(52) U.S. Cl.
CPC ..... *A41D 1/14* (2013.01); *A41D 15/002* (2013.01)

(58) Field of Classification Search
USPC ..... 2/269, 217, 105, 213, 223
See application file for complete search history.

(56) References Cited

U.S. PATENT DOCUMENTS 560,683 A * 5/1896 Brückner ..... A41D 15/002 D2/742
1,421,162 A * 6/1922 Buckley ..... A41D 15/02 2/71
2,687,530 A * 8/1954 Farnum ..... A41D 15/002 2/217
2,692,988 A 11/1954 Rouse
2,723,398 A * 11/1955 Tuteur ..... A41B 13/06 2/69.5
3,008,147 A * 11/1961 Yelton ..... A41D 15/00 2/70
4,106,125 A * 8/1978 Palumbo ..... A41D 15/02 2/213
4,477,928 A 10/1984 Graff
4,835,795 A * 6/1989 Lonon ..... A41B 9/08 2/408
5,299,323 A 4/1994 Schaefer et al.
5,367,709 A * 11/1994 Teasley ..... A41B 13/08 2/69

(Continued)

FOREIGN PATENT DOCUMENTS

GB 2260890 A * 5/1993 ..... A41D 11/00

*Primary Examiner* — Jameson D Collier
(74) *Attorney, Agent, or Firm* — Boudwin Intellectual Property Law, LLC; Daniel Boudwin

(57) ABSTRACT

An adjustable length garment device allowing an individual wearing a romper to remove, or partially remove, the romper without having to remove all of one's clothing or risking the romper from falling on the ground. The adjustable length garment device includes an elongated member dimensioned to cover a portion of the torso of the wearer. The elongated member includes an upper opening and a lower opening and a fastener disposed at the lower end of the elongated fabric member. The fastener divides the lower opening into a pair of leg openings when engaged. The leg openings define a lower channel including at least one drawstring. The at least one drawstring is connected to a first strap and a second strap, such that pulling upward on the first strap and the second strap will elevate the drawstring.

2 Claims, 4 Drawing Sheets

(56) References Cited

U.S. PATENT DOCUMENTS

| | | | | | |
|---|---|---|---|---|---|
| 5,546,606 | A * | 8/1996 | Luckabaugh | A41D 1/22 | 2/217 |
| 5,960,473 | A * | 10/1999 | Tajima | A41D 1/082 | 2/230 |
| RE36,905 | E * | 10/2000 | Noble | A41D 7/005 | 2/400 |
| 6,317,894 | B1 * | 11/2001 | Blechman | A41D 15/002 | 2/125 |
| 6,336,226 | B1 | 1/2002 | Garcia | | |
| 7,841,020 | B2 * | 11/2010 | Mayfield | A41D 13/02 | 2/232 |
| 8,091,147 | B2 | 1/2012 | Solowey | | |
| 8,850,620 | B1 * | 10/2014 | Carretero | A41D 15/002 | 2/269 |
| 10,362,817 | B2 * | 7/2019 | Arzu | A41D 15/04 | |
| 2009/0019616 | A1 * | 1/2009 | Smith | A41D 13/129 | 2/269 |
| 2011/0179548 | A1 * | 7/2011 | Weston | A41D 3/08 | 2/84 |
| 2014/0237699 | A1 | 8/2014 | Michaelis | | |
| 2014/0345029 | A1 * | 11/2014 | Saladino | A41D 15/002 | 2/84 |
| 2018/0132552 | A1 * | 5/2018 | Rivera | A41D 13/1236 | |

* cited by examiner

ADJUSTABLE LENGTH GARMENT DEVICE

CROSS REFERENCE TO RELATED APPLICATIONS

This application claims the benefit of U.S. Provisional Application No. 63/279,894 filed on Nov. 16, 2021. The above identified patent application is herein incorporated by reference in its entirety to provide continuity of disclosure.

BACKGROUND OF THE INVENTION

Many people wear rompers. Generally speaking, a romper is an article of clothing characterized by an elongated fabric piece designed to house both the upper portion and a lower portion of the wearer. Rompers generally comprise a number of upper openings for the wearer's arms and head and a pair of lower openings for the wearer's legs. Typically, the wearer will pull the romper up from his or her feet and then extend their hands and arms through the arm openings and his or her head through the upper opening.

However, in some situations, rompers are inconvenient for wearers. For example, when an individual wearing a romper must use a public restroom, washroom, or the like, he or she must usually fully remove the romper. In cases where the individual may not be wearing clothing underneath the romper, he or she may need to become fully naked in order to use the restroom. In addition to being inconvenient, this can also be uncomfortable, physically and mentally, with being naked in a public or unfamiliar location. Fully removing a romper can also expose the individual to the risks of being recorded by a hidden camera or subjected to other criminal actions.

In addition to fully removing the romper, the individual must also find a place to hang or store the romper while it is removed. If the location does not have a hook or a hanger, the individual may be required to hold the romper while using the restroom to avoid the romper falling onto a potentially dirty floor. When a romper falls onto a dirty floor, it may be rendered uncomfortable or unwearable if it becomes wet or dirty. This problem may be further exacerbated in situations where the individual needs to wipe or to clean themselves, as balancing the romper while doing other tasks can be difficult for the individual.

Therefore, there is a defined need amongst the known prior art references for an improved mechanism of allowing an individual wearing a romper to remove, or partially remove, the romper without having to remove all of one's clothing or risking the romper from falling on the ground.

SUMMARY OF THE INVENTION

In view of the foregoing disadvantages inherent in the known types of apparel lifting and removal structures now present in the prior art, the present invention provides a structurally-integrated garment, wherein the same can be utilized for providing convenience for the user when lifting the lower end of a romper, or similar garment.

In one embodiment, the present system comprises an elongated fabric member dimensioned to cover at least a portion of the torso of the wearer. The elongated fabric member comprises an upper opening, a pair of arm openings and a lower opening. A fastener is disposed at the lower end of the elongated fabric member. The fastener is configured to divide the lower opening into a pair of leg openings when engaged. the pair of leg openings define a lower channel. A drawstring is disposed around the lower channel. A first strap extends perpendicularly upward from the drawstring and outward from a first aperture. A second strap extends perpendicularly upward from the drawstring and outward from a second aperture. As such, lifting upward on the first strap and the second strap elevates the drawstring, raising the lower end of the elongated fabric member.

In another embodiment, the present system comprises an elongated fabric member dimensioned to cover at least a portion of the torso of the wearer. The elongated fabric member comprises an upper opening, a pair of arm openings and a lower opening. A fastener is disposed at the lower end of the elongated fabric member. The fastener is configured to divide the lower opening into a pair of leg openings when engaged. A first leg opening of the pair of leg openings defines a first lower channel. A second leg opening of the pair of leg openings defines a second lower channel. A first pair of drawstrings is disposed in the first lower channel. A second pair of drawstrings is disposed in the second lower channel. A first pair of straps extends perpendicularly upward from the first pair of drawstrings and outward from a first aperture. A second pair of straps extends perpendicularly upward from the second pair of drawstrings and outward from a second aperture. As such, lifting upward on the first pair of straps and the second pair of straps elevates the drawstrings, raising the lower end of the elongated fabric member.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
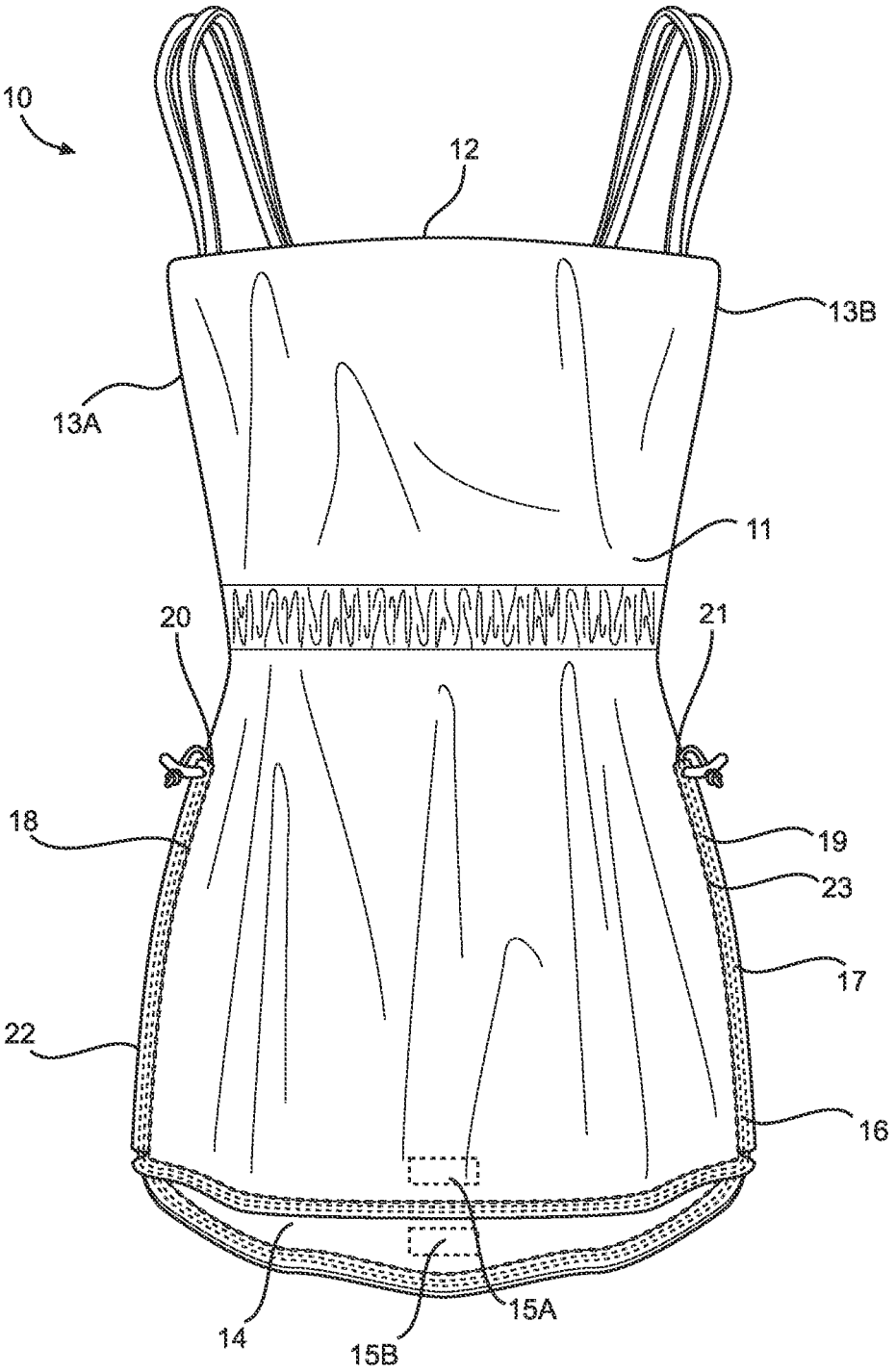
FIG. 1A shows a first demonstrative view of a first embodiment of the adjustable length garment device.

Reference is made herein to the attached drawings. Like reference numerals are used throughout the drawings to depict like or similar elements of the adjustable length garment device. The figures are intended for representative purposes only and should not be considered to be limiting in any respect.

Referring now to FIG. 1A, there is shown a first demonstrative view of a first embodiment of the adjustable length garment device. The adjustable length garment device 10 comprises an elongated fabric member 11. The elongated fabric member 11 is made of any suitable material of sufficient flexibility. The elongated fabric member 11 may be made of a single material, a blended material, or may comprise a plurality of sections made of different materials. The elongated fabric member 11 is dimensioned to cover at least a portion of the torso of the wearer. In the illustrated embodiment, the elongated fabric member 11 forms a romper. It is contemplated that the elongated fabric member 11 may comprise any standard element of apparel, such as one or more pockets, one or more elastic bands, one or more openings, one or more zippers, and one or more padded portions.

The elongated fabric member 11 comprises an upper opening 12. The upper opening 12 is dimensioned to receive the head and the neck of the wearer therethrough. The upper opening 12 may comprise a collar or may be defined between a plurality of shoulder straps, as desired by the designer. Furthermore, the elongated fabric member 11 comprises at least one arm opening 13*a*, 13*b*. In the illustrated embodiment, the elongated fabric member 11 comprises a pair of arm openings 13*a*, 13*b*. In some embodiments, at least one of the arm openings 13*a*, 13*b* comprises a sleeve configured to cover at least a portion of the wearer's shoulder and/or arm. The elongated fabric member 11 comprises a lower opening 14 disposed at the bottom of the elongated fabric member 11 opposite the upper opening 12. The lower opening 14 is of a sufficient circumference to accommodate being pulled over the torso, hips, and or thighs of the wearer.

A fastener 15*a*, 15*b* is disposed on the lower end of the elongated fabric member 11 on opposing sides of the lower opening 14. The fastener 15*a*, 15*b* is configured to secure one portion of the fabric member 11 to another in a secure manner. The fastener 15*a*, 15*b* comprises any suitable fastener for securing a back portion of the elongated fabric member 11 to a front portion of the elongated fabric member. For example, the fastener 15*a*, 15*b* may be a hook and loop fastener or may be a button fastener. In the illustrated embodiment, the fastener consists of a front fastener 15*a* disposed on the internal face of a front portion of the elongated fabric member 11 and a rear fastener 15*b* disposed on the external face of a rear portion of the elongated fabric member 11. Alternatively, the front fastener 15*a* may be on the external surface of the elongated fabric member 11 with the rear fastener 15*b* being on the internal surface of the elongated fabric member 11, the front fastener 15*a* and the rear fastener 15*b* may be on corresponding internal faces of the elongated fabric member 11, or the front fastener 15*a* and the rear fastener 15*b* may be on corresponding external faces of the elongated fabric member 11. Additionally, in the demonstrated embodiment, the fastener 15*a*, 15*b* is configured to divide the lower opening 14 into a pair of leg openings when engaged.

The lower opening 14 of the elongated fabric member 11 comprises a drawstring 16. In the illustrated embodiment, the drawstring 16 is circular and extends around the perimeter of the lower opening 14. The drawstring 16 is disposed in a lower channel 17 such that the circumference of the lower opening 14 may be manipulated by the drawstring 16. The drawstring 16 is of any suitable material for providing support to elevate the lower opening 14 of the elongated fabric member 11 without adding an uncomfortable amount of weight to the elongated fabric member 11 for the wearer.

The drawstring 16 is in operable connection with a first strap 18 and a second strap 19. The first strap 18 extends perpendicularly upward from a first side of the drawstring 16 and outward from a first aperture 20. The first strap 18 is configured to elevate the first side of the lower opening 14. The second strap 19 extends perpendicularly upward from a second side of the drawstring 16 and outward through a second aperture 21. The second strap 19 is configured to elevate the second side of the lower opening 14.

In the illustrated embodiment, the first strap 18 is disposed in a first channel 22. As such, the path of the first strap 18 will be defined and the function of the first strap 18 will not be interfered with by the wearer or by other elements of the adjustable length garment device. Additionally, in the illustrated embodiment, the second strap 19 is disposed in a second channel 23. As such, the path of the second strap 19 will be defined and the function of the second strap will not be interfered with by the wearer or by other elements of the adjustable length garment device 10.

Figure 1B:
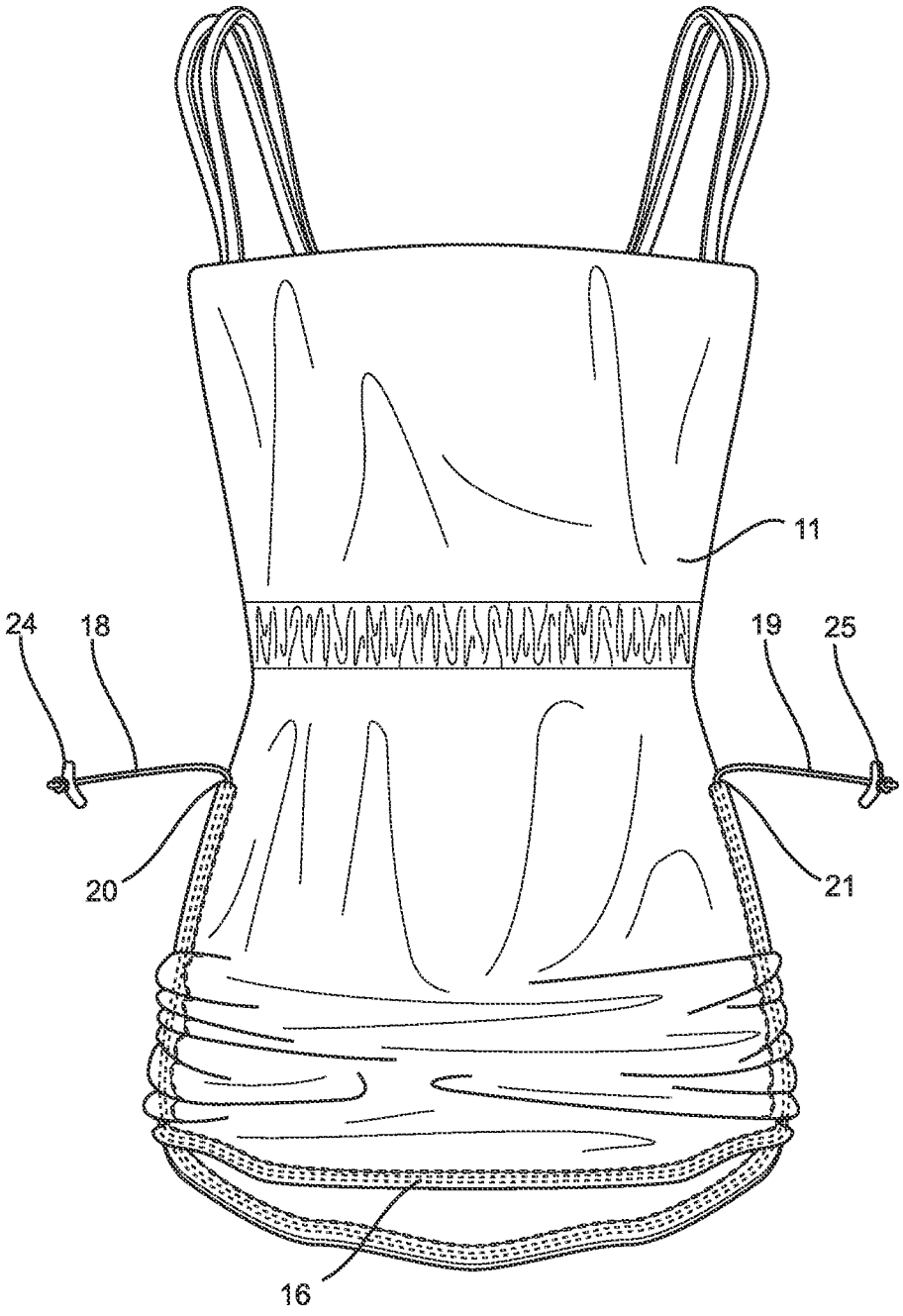
FIG. 1B shows a second demonstrative view of a first embodiment of the adjustable length garment device.

Referring now to FIG. 1B, there is shown a second demonstrative view of a first embodiment of the adjustable length garment device. In use, the wearer may pull outward and/or upward on the portions of the first strap 18 and the second strap 19 that extend outward from the first aperture 20 and the second aperture 21 respectively. As such, when the wearer lifts upward on the first strap 18 and the second strap 19, the drawstring 16 will be elevated, allowing for the lower portion of the elongated fabric member 11 to be selectively elevated by the wearer.

In the illustrated embodiment, the first strap 18 comprises a first handle 24. The first handle 24 is configured to assist the wearer in locating and pulling the first strap 18. In the specific illustrated embodiment, the first handle 24 is perpendicularly disposed on a distal end of the first strap 18. Additionally, in the illustrated embodiment, the second strap 19 comprises a second handle 25. The second handle 25 is configured to assist the wearer in locating and pulling the second strap 19. In the specific illustrated embodiment, the second handle 25 is perpendicularly disposed on a distal end of the second strap 19. In alternate embodiments, the first handle 24 and the second handle 25 may comprise a loop, a cord lock, or any other structure for assisting with the location or operation of the first strap 18 and the second strap 19.

Figure 2A:
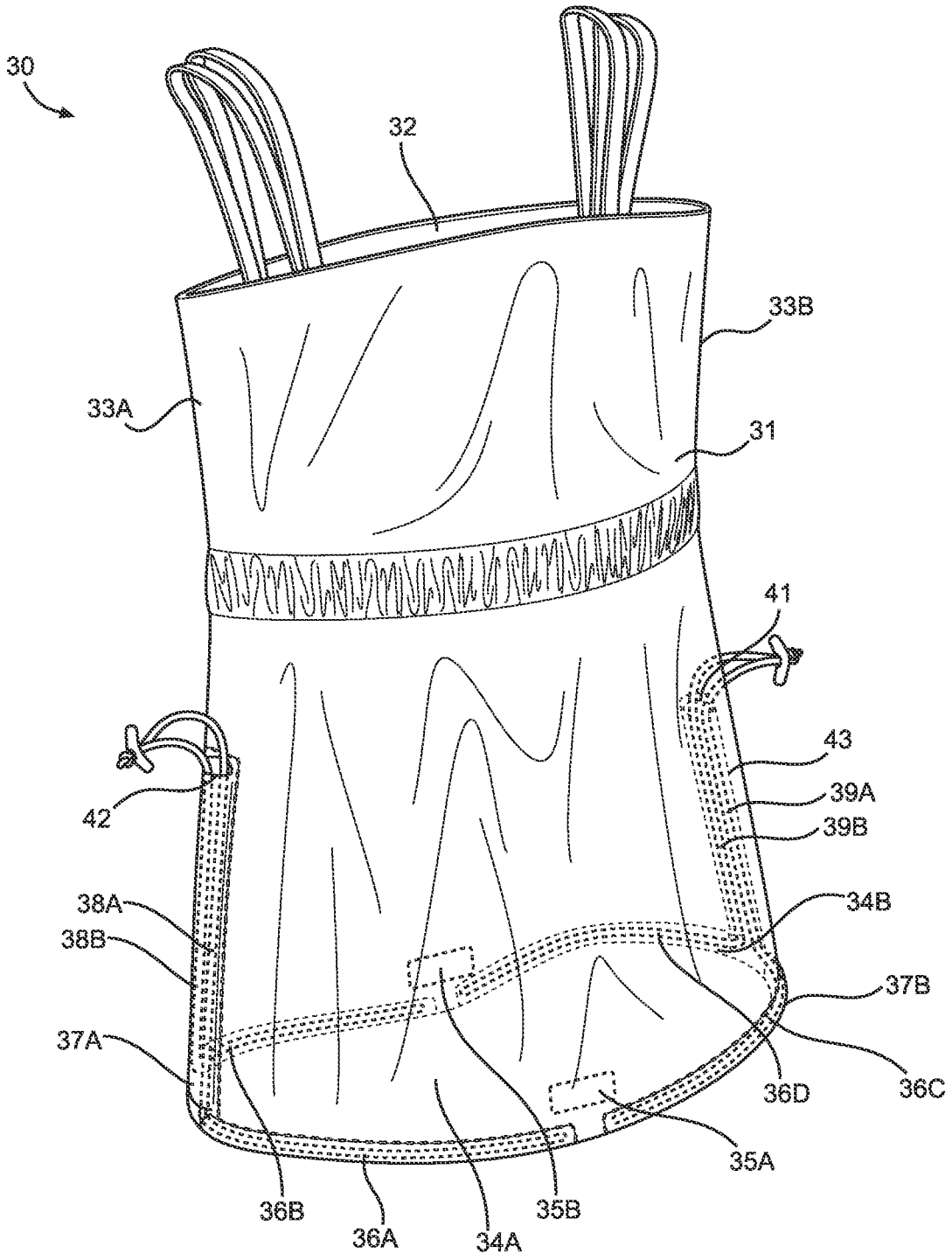
FIG. 2A shows a first demonstrative view of a second embodiment of the adjustable length garment device.

Referring now to FIG. 2A, there is shown a first demonstrative view of a second embodiment of the adjustable length garment device. The adjustable length garment device 30 comprises an elongated fabric member 31. The elongated fabric member 31 is made of any suitable material of sufficient flexibility. The elongated fabric member 31 may be made of a single material, a blended material, or may comprise a plurality of sections made of different materials. The elongated fabric member 31 is dimensioned to cover at least a portion of the torso of the wearer. In the illustrated embodiment, the elongated fabric member 31 forms a romper. It is contemplated that the elongated fabric member 31 may comprise any standard element of apparel, such as one or more pockets, one or more elastic bands, one or more openings, one or more zippers, and one or more padded portions.

The elongated fabric member 31 comprises an upper opening 32. The upper opening 32 is dimensioned to receive the head and the neck of the wearer therethrough. The upper opening 32 may comprise a collar or may be defined between a plurality of shoulder straps, as desired by the designer. Furthermore, the elongated fabric member 31 comprises at least one arm opening 33*a*, 33*b*. In the illustrated embodiment, the elongated fabric member 31 comprises a pair of arm openings 33*a*, 33*b*. In some embodiments, at least one of the arm openings 33*a*, 33*b* comprises a sleeve configured to cover at least a portion of the wearer's shoulder and/or arm. The elongated fabric member 31 comprises a lower opening 34*a*, 34*b* disposed at the bottom of the elongated fabric member 31 opposite the upper opening 32. The lower opening 34*a*, 34*b* is of a sufficient circumference to accommodate being pulled over the torso, hips, and or thighs of the wearer.

A fastener 35*a*, 35*b* is disposed on the lower end of the elongated fabric member 31 on opposing sides of the lower opening 34*a*, 34*b*. The fastener 35*a*, 35*b* is configured to secure one portion of the fabric member 31 to another in a secure manner. The fastener 35*a*, 35*b* comprises any suitable fastener for securing a back portion of the elongated fabric member 31 to a front portion of the elongated fabric member 31. For example, the fastener 35*a*, 35*b* may be a hook and loop fastener or may be a button fastener. In the illustrated embodiment, the fastener 35*a*, 35*b* consists of a front fastener 35*a* disposed on the internal face of a front portion of the elongated fabric member 31 and a rear fastener 35*b* disposed on the external face of a rear portion of the elongated fabric member 31. Alternatively, the front fastener 35*a* may be on the external surface of the elongated fabric member 31 with the rear fastener 35*b* being on the internal surface of the elongated fabric member 31, the front fastener 35*a* and the rear fastener 35*b* may be on corresponding internal faces of the elongated fabric member 31, or the front fastener 35*a* and the rear fastener 35*b* may be on corresponding external faces of the elongated fabric member 31. Additionally, in the demonstrated embodiment, the fastener 35*a*, 35*b* is configured to divide the lower opening 34 into a pair of leg openings when engaged.

The lower opening 34*a*, 34*b* of the elongated fabric member 31 comprises a first pair of drawstrings 36*a*, 36*b* and a second pair of drawstrings 36*c*, 36*d*. In the illustrated embodiment, the first pair of drawstrings 36*a*, 36*b* are disposed around opposing sides of the lower opening 34*a*, 34*b* defining a front and a rear of the first leg opening 34*a*. The first pair of drawstrings 36*a*, 36*b* is disposed in a first lower channel 37*a* such that the circumference of the first leg opening 34*a* may be manipulated by the first pair of drawstrings 36*a*, 36*b*. Furthermore, in the illustrated embodiment, the second pair of drawstrings 36*c*, 36*d* are each disposed around opposing sides of the lower opening 34*a*, 34*b* defining a front and a rear of the second leg opening 34*b*. The second pair of drawstrings 36*c*, 36*d* is disposed in a second lower channel 37*b* such that the circumference of the second leg opening 34*b* may be manipulated by the second pair of drawstrings 36*c*, 36*d*. The first pair of drawstrings 36*a*, 36*b* and the second pair of drawstrings 36*c*, 36*d* are of any suitable material for providing support to elevate the lower opening 34*a*, 34*b* of the elongated fabric member 31 without adding an uncomfortable amount of weight to the elongated fabric member 31 for the wearer.

The first pair of drawstrings 36*a*, 36*b* are each in operable connection with a first strap 38*a*, 38*b*, while the second pair of drawstrings 36*c*, 36*d* are each in operable connection with a second strap 39*a*, 39*b*. In the illustrated embodiment, each of the first pair of drawstrings 36*a*, 36*b* forms a single, unitary strand with the corresponding first strap 38*a*, 38*b*. Furthermore, in the illustrated embodiment, each of the second pair of drawstrings 36*c*, 36*d* forms a single, unitary strand with the corresponding second strap 39*a*, 39*b*. The first straps 38*a*, 38*b* extend perpendicularly upward from a terminal point of each of the first pair of drawstrings 36*a*, 36*b* and outward from a first aperture 40. The first straps 38*a*, 38*b* are configured to elevate the first leg opening 34*a*. The second straps 39*a*, 39*b* extend perpendicularly upward from a terminal point of each of the second drawstrings 36*c*, 36*d* and outward through a second aperture 41. The second straps 39*a*, 39*b* are configured to elevate the second leg opening 34*b*.

In the illustrated embodiment, the first straps 38*a*, 38*b* are disposed in a first channel 42. As such, the path of the first straps 38*a*, 38*b* will be defined and the function of the first straps 38*a*, 38*b* will not be interfered with by the wearer or by other elements of the adjustable length garment device 30. Additionally, in the illustrated embodiment, the second straps 39*a*, 39*b* are disposed in a second channel 43. As such, the path of the second straps 39*a*, 39*b* will be defined and the function of the second strap will not be interfered with by the wearer or by other elements of the adjustable length garment device 30.

Figure 2B:
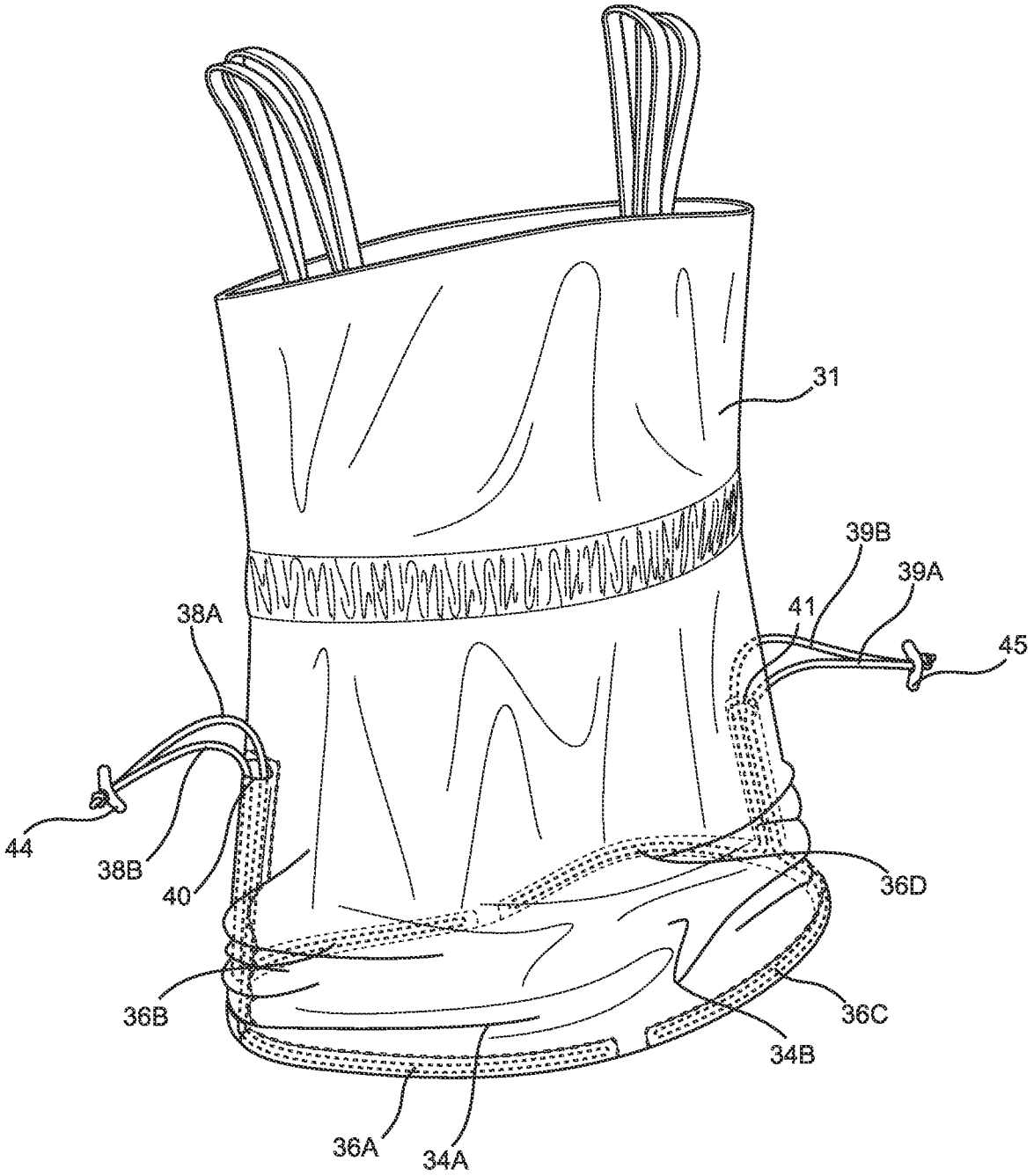
FIG. 2B shows a second demonstrative view of a second embodiment of the adjustable length garment device.

Referring now to FIG. 2B, there is shown a second demonstrative view of a second embodiment of the adjustable length garment device. In use, the wearer may pull outward and/or upward on the portions of the first straps 38*a*, 38*b* and the second straps 39*a*, 39*b* that extend outward from the first aperture 40 and the second aperture 41 respectively. As such, when the wearer lifts upward on the first straps 38*a*, 38*b* and the second straps 39*a*, 39*b*, the first pair of drawstrings 36*a*, 36*b* and the second pair of drawstrings 36*c*, 36*d* will be elevated and drawn outward, allowing for the first leg opening 34*a* and the second leg opening 34*b* of the elongated fabric member 31 to be selectively elevated by the wearer.

In the illustrated embodiment, the first straps 38*a*, 38*b* comprise a first handle 44. The first handle 44 is configured to assist the wearer in locating and pulling the first straps 38*a*, 38*b*. In the specific illustrated embodiment, the first handle 44 is perpendicularly disposed on a distal end of the first straps 38*a*, 38*b*. Additionally, in the illustrated embodiment, the second straps 39*a*, 39*b* comprise a second handle 45. The second handle 45 is configured to assist the wearer in locating and pulling the second straps 39*a*, 39*b*. In the specific illustrated embodiment, the second handle 45 is perpendicularly disposed on a distal end of the second straps 39*a*, 39*b*. In alternate embodiments, the first handle 44 and the second handle 45 may comprise a loop, a cord lock, or any other structure for assisting with the location or operation of the first straps 38*a*, 38*b* and the second straps 39*a*, 39*b*.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable length garment device, consisting of:

an elongated fabric member dimensioned and adapted to cover at least a portion of a torso of a wearer;

wherein the elongated fabric member includes an upper opening and a lower opening;

wherein the elongated fabric member forms a romper;

a fastener disposed at a lower end of the elongated fabric member;

wherein the fastener divides the lower opening into a pair of leg openings when engaged, such that the pair of leg openings define a lower channel;

a drawstring disposed around the lower channel;

a first strap extending perpendicularly upward from the drawstring and outward from a first aperture;

a second strap extending perpendicularly upward from the drawstring and outward from a second aperture;

wherein the first strap includes a first handle perpendicularly disposed on a distal end of the first strap;

wherein the second strap includes a second handle perpendicularly disposed on a distal end of the second strap;

wherein when the wearer lifts upward on the first strap and the second strap, the drawstring is elevated, allowing for a lower portion of the elongated fabric member to be selectively elevated by the wearer;

wherein the first handle and the second handle each include a respective cord lock for assisting with the location or operation of the first strap and the second strap;

wherein the first strap is disposed in a first channel;

wherein the second strap is disposed in a second channel;

wherein the fastener is a button fastener or a hook and loop fastener;

wherein the elongated fabric member includes a pair of arm openings; and wherein the drawstring is circular and extends around a perimeter of the lower opening.

2. An adjustable length garment device, consisting of:

an elongated fabric member dimensioned and adapted to cover at least a portion of a torso of a wearer;

wherein the elongated fabric member includes an upper opening and a lower opening;

a fastener disposed at a lower end of the elongated fabric member;

wherein the elongated fabric member forms a romper;

wherein the fastener divides the lower opening into a pair of leg openings when engaged, such that a first leg opening of the pair of leg openings defines a first lower channel and a second leg opening of the pair of leg openings defines a second lower channel;

a first pair of drawstrings disposed on opposing sides of the first lower channel;

a second pair of drawstrings disposed on opposing sides of the second lower channel;

a first pair of straps extending perpendicularly upward from the first pair of drawstrings and outward from a first aperture;

a second pair of straps extending perpendicularly upward from the second pair of drawstrings and outward from a second aperture;

wherein the first pair of drawstrings is elevated when the first pair of straps is lifted upward and the second pair of drawstrings is elevated when the second pair of straps is lifted upward, allowing for a lower portion of the elongated fabric member to be selectively elevated by the wearer;

wherein the first pair of straps includes a first handle perpendicularly disposed on a distal end of the first pair of straps;

wherein the second pair of straps includes a second handle perpendicularly disposed on a distal end of the second pair of straps;

wherein the first handle and the second handle each include a respective cord lock for assisting with the location or operation of the first strap and the second strap;

wherein the first strap is disposed in a first channel;

wherein the second strap is disposed in a second channel;

wherein the fastener is a button fastener or a hook and loop fastener; and wherein the elongated fabric member includes a pair of arm openings.

* * * * *